US005269523A

United States Patent [19]

Boylan et al.

[11] Patent Number: 5,269,523

[45] Date of Patent: Dec. 14, 1993

[54] MATCH NUMBER GAME DISPLAY APPARATUS AND METHOD

[75] Inventors: Eugene B. Boylan, Zephyr Cove; Anthony J. Delise, State Line; Robert F. Koerner, Gardnerville, all of Nev.

[73] Assignee: Bet Technology, Inc., Carson City, Nev.

[21] Appl. No.: 932,236

[22] Filed: Aug. 19, 1992

[51] Int. Cl.[5] ..... A63F 3/06

[52] U.S. Cl. ..... 273/138 R; 273/269

[58] Field of Search ..... 273/138 R, 138 A, 139, 273/269

[56] References Cited

U.S. PATENT DOCUMENTS

| | | | |
|---|---|---|---|
| 2,791,430 | 5/1957 | King | 273/269 |
| 4,019,744 | 4/1977 | Pizur, Sr. | 273/269 |
| 5,011,157 | 4/1991 | Lovell | 273/269 |
| 5,129,652 | 7/1992 | Wilkinson | 273/139 |

*Primary Examiner*—Benjamin H. Layno

*Attorney, Agent, or Firm*—Larson and Taylor

[57] ABSTRACT

An apparatus and method are provided for displaying series of winning numbers of a multiple spot class number match game. A first display device displays for first spot class a first primary winning numbers and at least one first bonus winning number in a first line. A second succeeding display device displays for a second spot class a second succeeding series of winning numbers comprising one of (a) second primary winning numbers comprising the first primary winning numbers and the at least one first bonus winning number, and at least one second bonus winning number, or (b) at least two bonus winning numbers comprising the at least one first bonus winning number and at least one of said first primary winning numbers, and a second series of primary winning numbers comprising a remainder of the first primary numbers and at least one second primary winning number. The same winning numbers in the first and second series are displayed adjacent one another. Preferably, the number game includes first payoffs for picking numbers in a spot class which correspond with the primary winning numbers of that spot class and a second payoff for picking numbers which correspond with any of the winning numbers of that spot class. Each display device includes primary and bonus designation mechanisms such as colors for differently designating the primary and bonus winning numbers. A pay chart indicating various payoffs for the classes is also provided.

18 Claims, 3 Drawing Sheets

MATCH NUMBER GAME DISPLAY APPARATUS AND METHOD

FIELD OF THE INVENTION

The present invention relates generally to the display of winning numbers (as used herein, "numbers" refers to numerals which are typically used in lottery or keno type games or any other symbol which may be similarly used), and more particularly to the displaying of multiple spot classes of winning numbers and payoffs therefor.

BACKGROUND OF THE INVENTION

In lottery games, the winning numbers are typically picked or drawn in some manner which serves additionally as a display. Thus, numbered balls are frequently used and the display of the selected balls serves as a display of the winning numbers. Alternately, or additionally, the selected numbers can be displayed as a list. For keno games, winning numbers are typically displayed using a sample card (containing a matrix of the possible numbers) with the selected numbers lighted or otherwise indicated. While these means for display are satisfactory, they do limit the variations of the games and the manner in which the games can be played.

Games of general interest which have playing boards or cards which use color as a distinguishing mechanism are disclosed in U.S. Pat. Nos. 2,791,430 (King) and 4,019,744 (Pizur, Sr.).

SUMMARY OF THE INVENTION

In accordance with the present invention, an apparatus and method are provided for displaying winning numbers in a lottery or keno type of number match game such that variations of the games and the manner in which the games are played are easily made as desired while still providing a readily understood display. In particular, the apparatus is used for displaying series of winning numbers of a multiple spot class number match game of the lottery or keno type. In such games, the winning numbers are drawn from a predetermined group of numbers after players initially select player numbers for a spot class which are desired to match for that spot class one of at least some primary winning numbers or some of the primary winning numbers and at least one bonus winning number. This apparatus includes a first display means for displaying for a first spot class a first series of primary winning numbers and at least one first bonus winning number in a first line. In addition, the apparatus also includes a second succeeding display means for displaying for a second spot class a second succeeding series of winning numbers. The second series of winning numbers comprises one of (a) a second series of primary winning numbers comprising the first series of primary winning numbers and the at least one first bonus winning number, and at least one second bonus winning number, and (b) at least two bonus winning numbers comprising the at least one first bonus winning number and at least one of said first series of primary winning numbers, and a second series of primary winning numbers comprising a remainder of the first series of primary numbers and at least one second primary winning number. The second series of winning numbers is provided in a second line parallel to the first line with the same winning numbers in the first and second series adjacent one another.

In a preferred embodiment, the number game includes first payoffs for the picking of player numbers in a spot class which correspond with the primary winning numbers of that spot class and a second payoff for the picking of player numbers in that spot class which correspond with any of the winning numbers of that spot class. For that reason, each of the display means for the spot classes includes a primary designation means for designating the primary winning numbers of that spot class and a bonus designation means for designating all bonus winning numbers of that spot class.

In the preferred embodiment, the bonus designation means of each respective series is located at an end of the series, and the bonus designation means include at least one additional bonus winning number for each succeeding bonus designation means. A pay chart which indicates payoffs for various matching numbers of each spot class is also advantageously included.

According to the preferred embodiment, the display apparatus further includes a third succeeding display means for displaying for a third spot class a third succeeding series of winning numbers. Similar to the other display means, the third series of winning numbers comprises one of (a) a third series of primary winning numbers comprising the second series of primary winning numbers and the at least one second bonus winning number, and at least one third bonus winning number, and (b) at least two bonus winning numbers comprising the at least one second bonus winning number and at least one of said second series of primary winning numbers, and a third series of primary winning numbers comprising a remainder of the second series of primary numbers and at least one third primary winning number. The third series of winning numbers is thus provided in a third line parallel to the second line with the same winning numbers in the second and third series adjacent one another.

In one preferred embodiment, the designation means are configured as follows: the primary designation means of the first display means designates three primary winning numbers and the bonus designation means of the first display means designates one bonus winning number; the primary designation means of the second display means thus designates four primary winning numbers and the bonus designation means of the second display means designates two bonus winning numbers; and the primary designation means of the third display means thus designates five primary winning numbers and the bonus designation means of the third display means designates three bonus winning numbers.

According to the preferred embodiment, the primary designation means include a means for coloring the primary winning numbers displayed thereby a first color and the bonus designation means include a means for coloring the bonus winning numbers displayed thereby with a second color different from the first color of the primary designation means. The series of winning numbers of the display means are conveniently arranged in a parallel rows with the same winning numbers vertically adjacent one another or diagonally adjacent one another.

The pay chart which shows the payoffs for various spot classes preferably includes groupings for each of the spot classes. Each grouping shows a payoff for selecting all of the primary winning numbers, and at least one addition payoff for selecting some of the primary winning numbers and at least one bonus winning number of that same spot class.

A method for displaying series of winning numbers of a number match game is also provided in accordance with the present invention for use with the type of number match game as described above. This method comprises the steps of displaying for a first spot class with a first display means a first series as described above and the displaying for a second spot class with a second succeeding display means a second succeeding series as also described above.

The displaying steps for each display means preferably includes the step of designating with a primary designation means the primary winning numbers of that series and designating with a bonus designation means all bonus winning numbers of the series. In addition, the displaying steps also include the locating of the bonus designation means of each respective series at an end of the series.

The preferred method further includes the step of displaying for a third spot class with a third succeeding display means a third succeeding series of winning numbers as also described above. This third series of winning numbers is then provided in a third line parallel to the second line with the same winning numbers in the second and third series adjacent one another.

In the preferred method, the displaying steps include the displaying with the bonus designation means at least one additional bonus number for each succeeding bonus designation means. In addition, the method further includes the step of displaying a pay chart which indicates payoffs for the matching of various player numbers with winning numbers of each spot class. Further, the designating step with the primary designation means includes the coloring of the primary winning numbers displayed with a first color and the coloring of the bonus winning numbers displayed with a second color different from the first color.

It is an object of the present invention to provide a display which is simple to understand and operate.

It is also an object of the present to provide a display which allows for various changes and modifications in the basic types of lottery and keno games so that these games can be customized as desired by the user.

It is a further object of the invention to provide a display which allows the use of bonus numbers in the games to increase interest and/or interest in playing of the games.

Other features and objects of the present invention are stated in or apparent from detailed descriptions of presently preferred embodiments of the invention found hereinbelow.

DETAILED DESCRIPTION OF THE PREFERRED EMBODIMENTS

Figure 1:
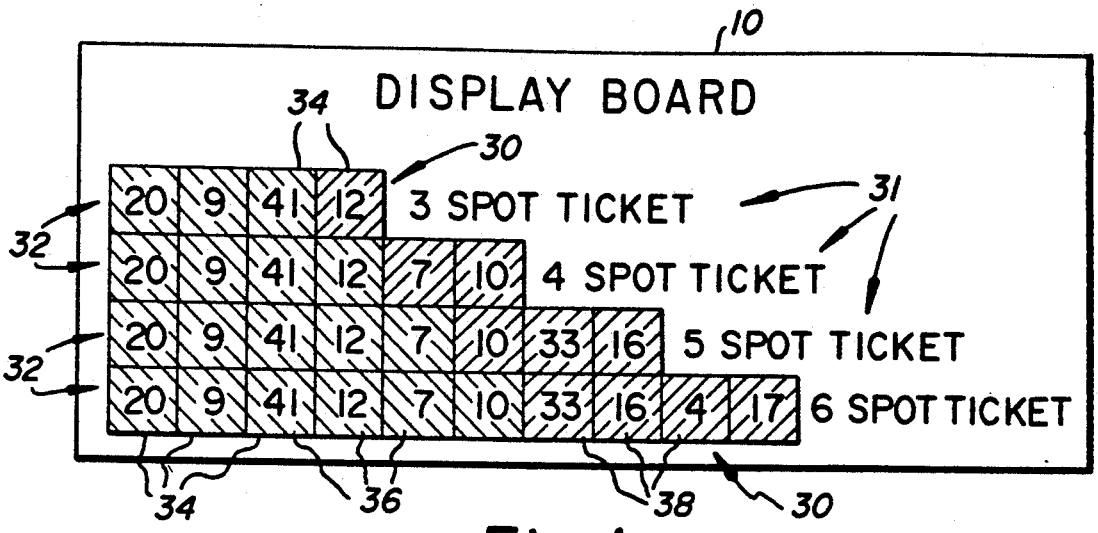
FIG. 1 is a schematic front view of a display board of the display apparatus of the present invention.
Figure 2:
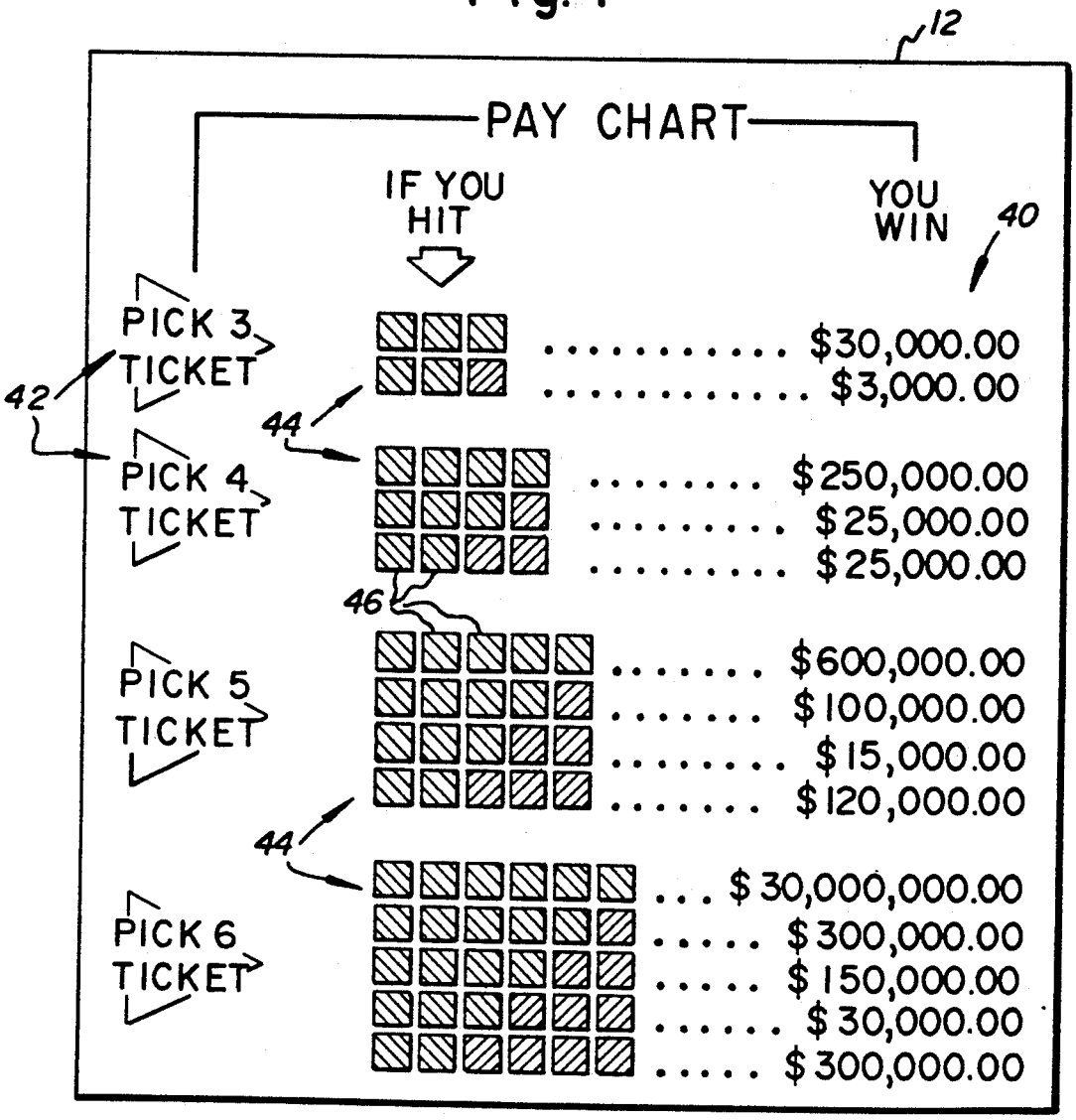
FIG. 2 is a schematic front view of a pay chart of the display apparatus of the present invention.
Figure 3:
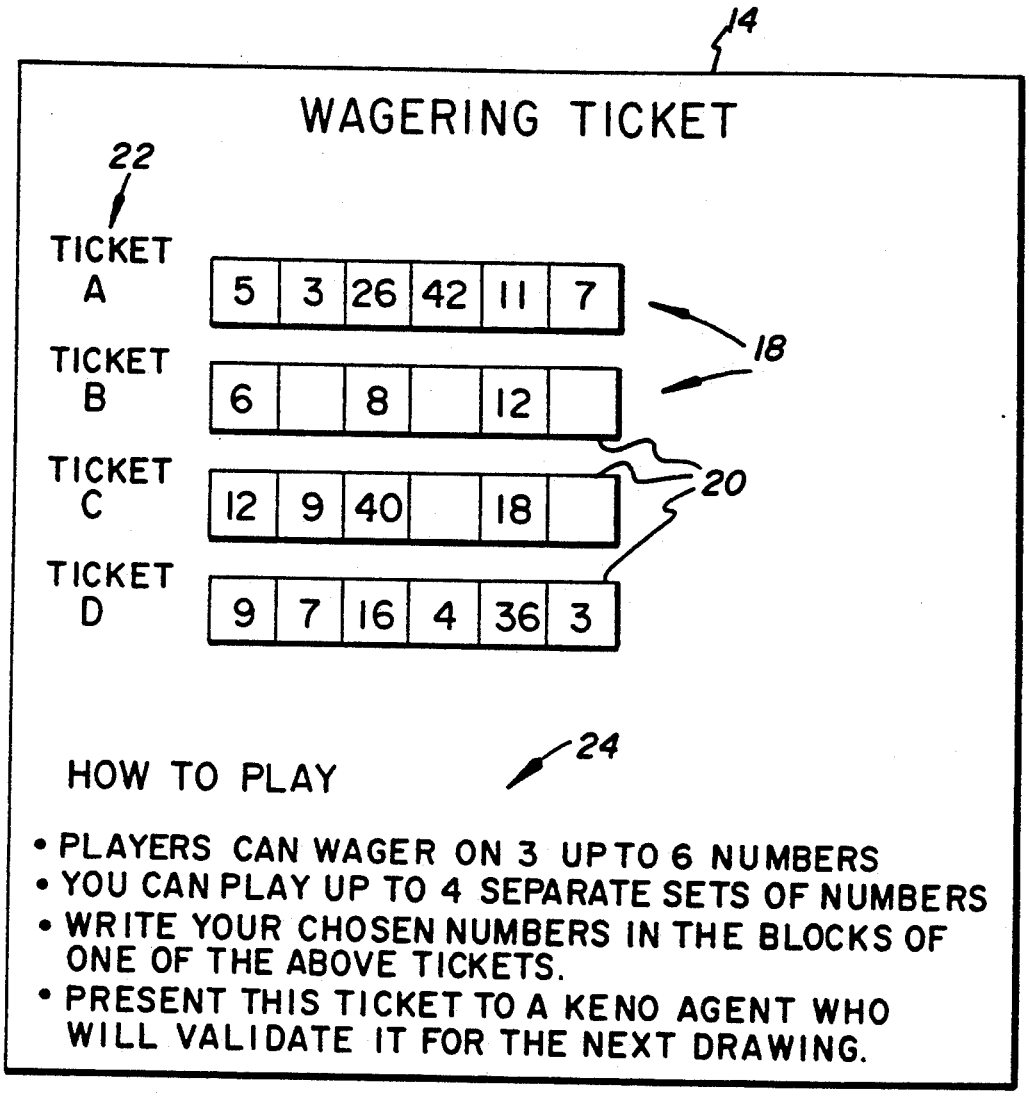
FIG. 3 is schematic front view of a wagering ticket useable with the display apparatus of the present invention.
Figure 4:
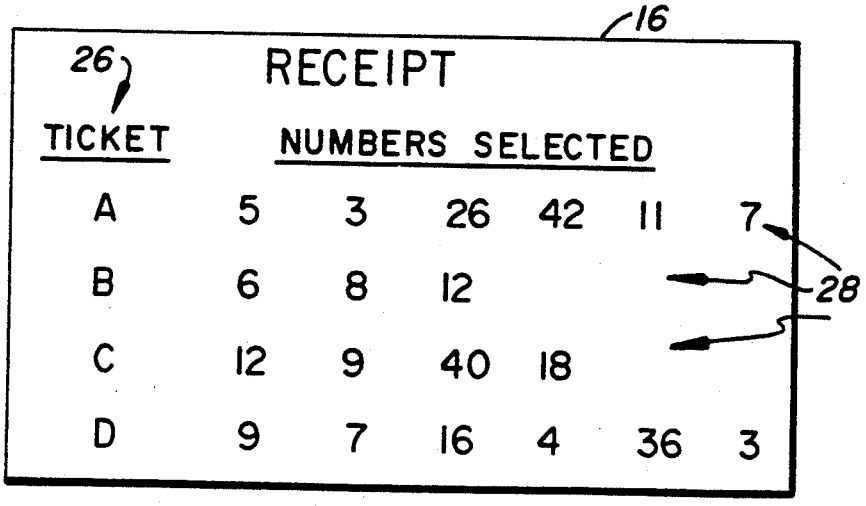
FIG. 4 is a schematic front view of a receipt for the wagering ticket of FIG. 3 useable with the display apparatus of the present invention.

With reference now to the drawings in which like numerals represent like elements, a display board 10 and a pay chart 12 comprising a display apparatus according to the present invention are depicted in FIGS. 1 and 2, respectively. In order to best understand the display apparatus of the present invention, it will be helpful to understand the nature of the play of the wagering games with which the display apparatus is used. Therefore, depicted in FIGS. 3 and 4 are an exemplary wagering ticket 14 and receipt 16 which could be used with the games. As will be appreciated by those of ordinary skill in the art, there are a wide variety of wagering games and associated tickets and receipts which would be possible so that those shown are only used to help illustrate the nature of the games for which the display apparatus would be useful.

The type of wagering games which the display apparatus of the present invention is directed is those similar to a lottery or keno game. These are broadly described as number match games, but it will be appreciated that numbers are only one type of symbol which can be used. Therefore, as used herein, "number" should be interpreted to include any such symbols. Examples of other symbols would include letters, playing cards, pictorial representations (such as nation flags, sport insignias, etc.) and combinations of any of these symbols.

To begin a match number game, the player is given the opportunity to select one or a plurality of player numbers from a predetermined group of numbers. For wagering ticket 14, the predetermined numbers available for selection would conveniently number from 1 to 49 (but this could obviously differ depending on the odds desired). In this game, it will also be appreciated that the player is afforded the opportunity to make up to four wagers on four different sets of player numbers (thus only one wager on one set of player numbers would be acceptable). On wagering ticket 14, this is indicated by strings 18 of blank blocks 20 in which blocks 20 a player number can be written. For identification, strings 18 are labeled with suitable indicia 22, which in this case identifies each string as a separate "ticket" labeled "A" to "D". Preferably, directions for the playing of the game are also included on wagering ticket 14 such as by indicia 24.

In this game, the player is further given the option of playing (selecting) from three to six player numbers for each ticket (wager). Thus, where blocks 20 are left blank, this indicates that less than the maximum amount of player numbers have been selected or "spotted". It will thus be appreciated that ticket A is a six spot ticket, ticket B is a three spot ticket, etc. As explained subsequently, each of the different spot tickets is thus associated with a respective spot class (having a certain quantity of winning numbers).

It will be appreciated that there will typically be a large number of players for each game. For convenience, each player is given a receipt for the player numbers selected with each wager, such as receipt 16 depicted in FIG. 4. Receipt 16 thus lists the ticket designation in a column 26 and the various player numbers selected in rows 28 adjacent to the ticket designations.

After collecting the various wagering tickets and issuing receipts, winning numbers are then drawn typically at some preset time with some preset mechanism. In order to display the winning numbers drawn in an easily identifiable manner, display board 10 is used. As there are different spot classes, display board 10 includes a display means 30 for each spot class (in this case three to six, as shown) which spot classes are identified with indicia 31. Conveniently, each display means 30 is a line 32 of cells 34 which can be lit up with any one of the group of numbers.

With this game, there are drawn more winning numbers than the spots (numbers) chosen for the spot class. These winning numbers are of two varieties, primary winning numbers and bonus winning numbers, for use as explained subsequently. In order to differentiate the primary winning numbers from the bonus winning numbers in each display means 30, each display means 30 includes a primary designation means 36 and a bonus designation means 38. Conveniently, each designation means 36 and 38 are simply a differently colored cover or background for the associated cells 34 which are schematically indicated in FIG. 1 by opposite slashing lines. Obviously, any choice of colors or other such designation mechanism would be usable so long as the players can easily differentiate between the different varieties of winning numbers.

For simplicity and convenience of playing the game, it will also be appreciated that the winning numbers of one line 32 are used as winning numbers in the next or succeeding line 32. In particular, for display board 10, the first winning number drawn is "20", and this number is then identified in the first cell 34 of each line 32 as a primary winning number (this would most likely be done electronically as well appreciated by those of ordinary skill in the art). Similarly, as numbers "9" and "41" are drawn, these numbers are also identified in the second and third cells 34 of each line 32 as primary winning numbers. The fourth number drawn, "12", is used as a bonus winning number for the three spot class and is thus identified with bonus designation means 38 in the first line 32 as such. However, in the succeeding lines 32, this drawn number "32" is instead used as a primary winning number and is thus identified as such with primary designation means 36.

This pattern is thus carried out as the remainder of cells 34 are filled. In particular, it will be appreciated that each succeeding line 32 includes as the primary winning numbers thereof (a) the same series of primary winning numbers of the previous line 32 with the addition of one (or more if desired) bonus winning number from the previous line. In addition, each succeeding line 32 will include as the bonus winning numbers thereof any other (if the previous line 32 had more than one) bonus winning numbers from the previous line 32 and at least one newly drawn number. In the preferred embodiment, it will thus be appreciated that there is an additional bonus winning number for each succeeding series of numbers in lines 32.

For convenience, the bonus winning numbers are provided at the end of each line 32 (the end of the series of winning numbers). It will further be appreciated that the same winning numbers (either primary or bonus) of each line are located vertically adjacent one another in this preferred embodiment.

As indicated above, the display apparatus of the present invention also preferably includes pay chart 12. Pay chart 12 is obviously exemplary and is used to allow the players to quickly and easily determine if they have won on any of their tickets, and to show what they have won. Pay chart 12 includes suitable indicia contained in a column 40 indicating the payoff if matching player numbers were selected for corresponding spot classes. The spot classes are designated by indicia 42. In addition, for each spot class, there are groupings 44 of cells 46 which correspond to different payoffs for that spot class. It will also be appreciated that cells 46 are provided with one of two designations which correspond or are similar to designation means 36 and 38 of cells 34. Thus, groupings 44 are used to show the players different combinations of winnings depending on whether all of the player numbers match all of the primary winning numbers or combinations of the primary winning numbers and bonus winning numbers for the associated spot class.

In particular, there is a greater payoff for selecting player numbers which match all primary winning numbers in a spot class, and lesser payoffs for selecting player numbers which match some primary winning numbers and some bonus winning numbers. For example, with a spot class ticket for four player numbers, if the player numbers selected correspond to the four primary numbers displayed in display board 10, the player would win $250,000. However, if three of the player numbers matched three of the primary winning numbers and the fourth player number matched one of the two bonus winning numbers ("7" or "10" as shown in display board 10), then the player would win $25,000. Finally, if two of the player numbers matched two of the primary winning numbers and the other two player numbers matched the two bonus winning numbers ("7" or "10" as shown in display board 10), then the player would also win $25,000.

While the use of additional payoffs in a spot class will increase the payout for a particular game, the odds can be easily adjusted by adding numbers to the predetermined group of numbers to achieve approximately the same hold percentage for the game organizer. Thus, it is anticipated that one of the benefits of the game will be that additional interest will be generated and thus more players will participate or the players will participate with more tickets. This in turn will result in a greater profit for the game organizer.

Figure 5:
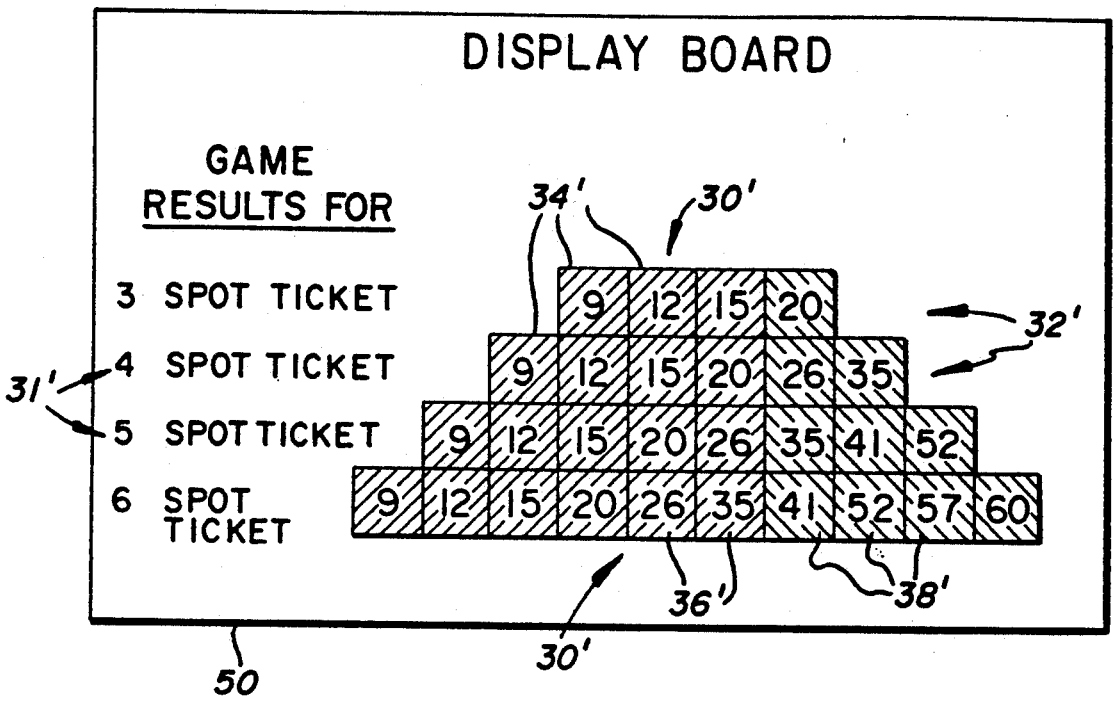
FIG. 5 is a schematic front view of an alternative embodiment of a display board of the display apparatus of the present invention.

Depicted in FIG. 5 is an alternative embodiment of a display board 50. Display board 50 is basically similar to display board 10 and includes similar elements which are numbered with the same numerals used for display board 10 but with a prime (') added. Thus, display board 50 includes a plurality of display means 30' having lines 32' of cells 34', and cells 34' are provided with primary designation means 36' and bonus designation means 38'. The spot classes are identified with indicia 31'. In display board 50, it will be appreciated that cells 34' containing the same winning numbers are not vertically adjacent one another, but rather are diagonally adjacent one another. This creates a more balanced display which is perhaps more pleasing to the eye than display board 10 and still is relatively easy to read.

Figure 6:
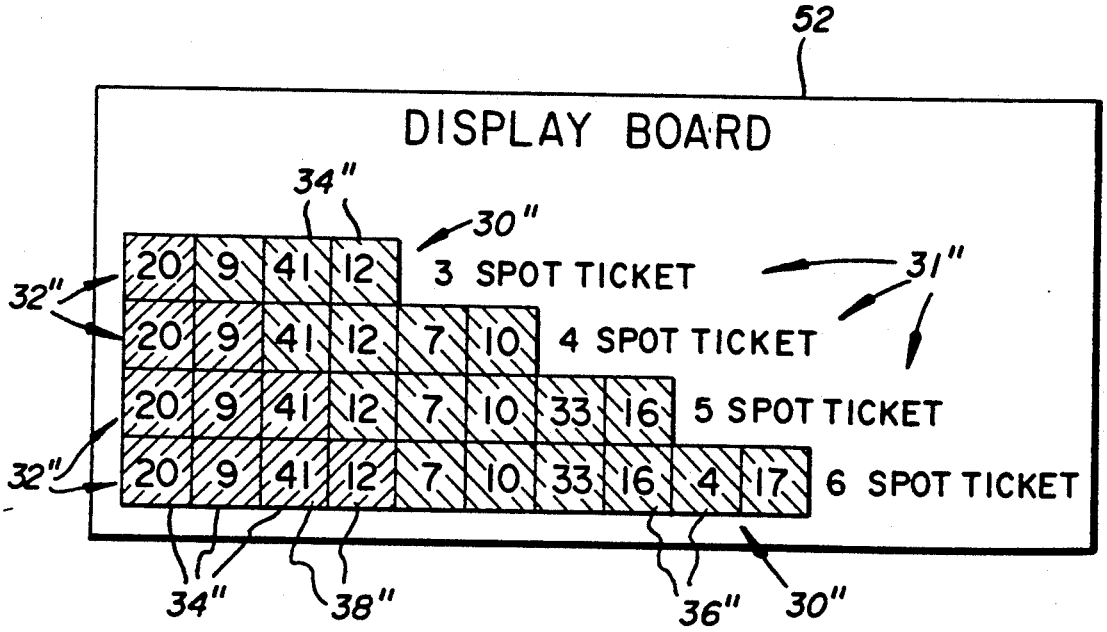
FIG. 6 is a schematic front view of another alternative embodiment of a display board of the display apparatus of the present invention similar to that of FIG. 1.

Depicted in FIG. 6 is another alternative embodiment of a display board 52. Display board 52 is laid out the same as display board 10 and includes similar elements which are numbered with the same numerals used for display board 10 but with a double prime (") added. Thus, display board 52 includes a plurality of display means 30" having lines 32" of cells 34", and cells 34" are provided with primary designation means 36" and bonus designation means 38". The spot classes are identified with indicia 31".

In display board 52, it will be appreciated that the bonus numbers are listed first in each line 32", and thus some of the primary winning numbers of one line 32" are then used as bonus winning numbers in a succeeding line 32" (which is the opposite of display board 10). Thus, instead of each succeeding line 32 including as primary winning numbers the preceding line's primary winning numbers and one of the bonus numbers as in display board 10 of FIG. 1, each succeeding line 32" includes as bonus winning numbers the preceding line's bonus winning numbers and one of the primary winning numbers. Similarly, instead of each succeeding line 32 including as bonus winning numbers a (or two) new bonus number, each succeeding line 32" includes as primary winning numbers some of the primary winning numbers from the preceding line (the remaining primary numbers from the preceding line which were not used in the subsequent line 32" as bonus winning numbers) and two new primary winning numbers.

In the same manner that display board 10 was configured into display board 52, it will be appreciated that display board 50 could also be configured with the bonus numbers first and the new numbers for each succeeding line being primary winning numbers. Further, suitable pay charts would be configured similar to the display board used in the manner of pay chart 12 and display board 10.

It will be appreciated that any one of the display boards 10, 50 and 52 can be used as desired. Further, there are other variations of such display boards and pay charts which can be similarly constructed and used to achieve the same benefits as the disclosed embodiments. Therefore, while the present invention has been described with respect to exemplary embodiments thereof, it will be understood by those of ordinary skill in the art that variations and modifications can be effected within the scope and spirit of the invention.

What is claimed is:

1. A method for displaying a plurality of series of winning numbers for respective spot classes of a number match game wherein a quantity of the winning numbers necessary to fill a largest spot class are drawn from a predetermined group of numbers after players initially select player numbers for various ones of the spot classes which player numbers are desired to match at least some of the winning numbers of the series of winning numbers of that spot class, the series of winning numbers of a respective spot class being made up of some of the quantity of winning numbers which are designated for that spot class as (a) primary winning numbers and (b) at least one winning number designated for that spot class as a bonus winning number wherein a match by the player numbers with just the primary winning numbers results in a first payoff and the match of the player numbers with the series of winning numbers results in a second payoff different from the first payoff, comprising the step of:

displaying for a first spot class with a first display means a first series of winning numbers including first primary winning numbers and at least one first bonus winning number in a first line; and displaying for a second spot class with a second succeeding display means a second succeeding series of winning numbers comprising one of (a) second primary winning numbers comprising all of the first primary winning numbers and the at least one first bonus winning number, and at least one second bonus winning number, or (b) at least two bonus winning numbers comprising the at least one first bonus winning number and at least one of said first primary winning numbers leaving a remainder of first primary numbers, and second primary winning numbers comprising the remainder of the first primary numbers and at least one second primary winning number, the second series of winning numbers being in a second line parallel to the first line with the same winning numbers in the first and second series adjacent one another.

2. A method for displaying as claimed in claim 1 wherein said displaying steps for each display means includes the step of designating with a primary designation means the primary winning numbers of that series and designating with a bonus designation means all bonus winning numbers of the series.

3. A method for displaying as claimed in claim 2 wherein said displaying steps include the locating of the bonus designation means of each respective series at an end of the series.

4. A method for displaying as claimed in claim 3 and further including the step of displaying for a third spot class with a third succeeding display means a third succeeding series of winning numbers comprising one of (a) third primary winning numbers comprising all of the second primary winning numbers and the at least one second bonus winning number, and at least one third bonus winning number, or (b) at least two bonus winning numbers comprising the at least one second bonus winning number and at least one of said second primary winning numbers leaving a remainder of second primary numbers, and third primary winning numbers comprising the remainder of the second primary numbers and at least one third primary winning number, the third series of winning numbers being in a third line parallel to the second line with the same winning numbers in the second and third series adjacent one another.

5. A method for displaying as claimed in claim 4 wherein said displaying steps include the displaying with the bonus designation means at least one additional bonus number for each succeeding series of winning numbers.

6. A method for displaying as claimed in claim 5 and further including the step of displaying a pay chart which indicates payoffs for the matching of various player numbers with winning numbers of each spot class.

7. A method for displaying as claimed in claim 2 wherein said designating step with the primary designation means include the coloring of the primary winning numbers displayed with a first color and the coloring of the bonus winning numbers displayed with a second color different from the first color.

8. A combination of winning numbers of a game and an apparatus for displaying the winning numbers comprising:

a plurality of series of the winning numbers for respective spot classes of a number match game wherein a quantity of the winning numbers necessary to fill a largest spot class are drawn from a predetermined group of numbers after players initially elect player numbers for various ones of the spot classes which player numbers are desired to match at least some of the winning numbers of the series of winning numbers for that spot class, the series of winning numbers of a respective spot class being made up of some of the quantity of the winning numbers which are designated for that spot class as (a) primary winning numbers and (b) at least one winning number designated for that spot class as a bonus winning number, wherein a match by the player numbers with just the primary winning numbers results in a first payoff and the match of the player numbers with the series of winning numbers results in a second payoff different from the first payoff, said plurality of series of winning numbers including a first series of winning numbers for a first spot class including first primary winning numbers and at least one first bonus winning number, and a second succeeding series of winning numbers for a second spot class comprising one of (a) second primary winning numbers comprising all of the first primary winning numbers and the at least one first bonus winning number, and at least one second bonus winning number, or (b) at least two bonus winning numbers comprising the at least one first bonus winning number and at least one of said first primary winning numbers leaving a remainder of first primary winning numbers, and second primary winning numbers comprising the remainder of the first primary winning numbers and at least one second primary winning number;

a first display means for displaying for the first spot class the first series of winning numbers in a first line; and a second succeeding display means for displaying for the second spot class the second succeeding series of winning numbers, the second series of winning numbers being in a second line

9. A combination of winning numbers and a display apparatus as claimed in claim 8 wherein the number match game includes first payoffs for the picking of player numbers in a sot class which correspond with the primary winning numbers of that spot class and a second payoff for the picking of player numbers in that spot class which correspond with any of the winning numbers of that spot class; and wherein each said display means for the spot classes includes a primary designation means for designating the primary winning numbers of that spot class and a bonus designation means for designating all bonus winning numbers of that spot class.

10. A combination of winning numbers and a display apparatus as claimed in claim 2 wherein said display means display said bonus winning numbers at an end of an associated said series of winning numbers and wherein said bonus designation means of each respective said display means are located at an end of an associated said line.

11. A combination of winning numbers and a display apparatus as claimed in claim 3 wherein said plurality of series of winning numbers includes at least one additional bonus winning number for each succeeding series of winning numbers.

12. A combination of winning numbers and a display apparatus as claimed in claim 11 and further including a pay chart which indicates the payoffs for various matching numbers of each said spot class.

13. A combination of winning numbers and a display apparatus as claimed in claim 12 and further including a third succeeding series of winning numbers for a third spot class comprising one of (a) third primary winning numbers comprising all of the second primary winning numbers and the at least one second bonus winning number, and at least one third bonus winning number, or (b) at least two bonus winning numbers comprising the at least one second bonus winning number and at least one of said second primary winning numbers leaving a remainder of second primary winning numbers, and third primary winning numbers comprising the remainder of the second primary winning numbers and at least one third primary winning number; and a third succeeding display means for displaying for the third spot class the third series of winning numbers in a third line parallel to the second line with same winning numbers in the second and third series adjacent one another.

14. A combination of winning numbers and a display apparatus as claimed in claim 13 wherein said first series of winning numbers includes three primary winning numbers and one bonus winning number, wherein said second series of winning numbers thus includes four primary winning numbers and two bonus winning numbers; and wherein said third series of winning numbers thus includes five primary winning numbers and three bonus winning numbers.

15. A combination of winning numbers and a display apparatus as claimed in claim 9 wherein said primary designation means includes a means for coloring the primary winning numbers displayed thereby a first color and wherein said bonus designation means include a means for coloring the bonus winning numbers displayed thereby with a second color different from the first color of said primary designation means.

16. A combination of winning numbers and a display apparatus as claimed in claim 9 and further including a pay chart which shows the payoffs for various spot classes of matching numbers, said pay chart including groupings for each of the spot classes with each said groupings showing a payoff for selecting all of the primary winning numbers and at least one addition payoff for selecting some of the primary winning numbers and at least one bonus winning number.

17. A combination of winning numbers and a display apparatus as claimed in claim 8 wherein said series of winning numbers displayed by said display means are arranged in parallel rows with the same winning numbers immediately adjacent one another.

18. A combination of winning numbers and a display apparatus as claimed in claim 8 wherein said series of winning numbers displayed by said display means are arranged in parallel rows with the same winning numbers diagonally adjacent one another.

* * * * *